US005252138A

United States Patent [19]

Guymon

[11] Patent Number: 5,252,138

[45] Date of Patent: Oct. 12, 1993

[54] WATER/SURFACTANT PROCESS FOR RECOVERING HYDROCARBONS FORM SOIL IN THE ABSENCE OF EMULSIFYING THE OIL

[76] Inventor: E. Park Guymon, 4085 Eccles Ave., Ogden, Utah 84403

[21] Appl. No.: 835,252

[22] Filed: Feb. 13, 1992

Related U.S. Application Data

[63] Continuation-in-part of Ser. No. 607,995, Nov. 1, 1990, abandoned, which is a continuation-in-part of Ser. No. 490,089, Mar. 7, 1990, Pat. No. 4,968,412, which is a continuation-in-part of Ser. No. 297,670, Jan. 17, 1989, abandoned.

[51] Int. Cl.[5] ..... B01D 43/00; B08B 3/08

[52] U.S. Cl. ..... 134/42; 134/40; 210/691; 210/922; 210/925; 405/128; 252/174.21

[58] Field of Search ..... 134/40, 42; 210/691, 210/922, 925; 405/128; 252/174.21

[56] References Cited

U.S. PATENT DOCUMENTS 4,380,268 4/1983 Martin ..... 134/40

4,645,608 2/1987 Rayborn ..... 134/40

FOREIGN PATENT DOCUMENTS 4010236 1/1979 Japan ..... 134/40

800241 3/1981 U.S.S.R. ..... 134/40

2901927 3/1981 U.S.S.R. ..... 134/40

*Primary Examiner*—Theodore Morris

*Assistant Examiner*—Zeinab El-Arini

*Attorney, Agent, or Firm*—J. Winslow Young

[57] ABSTRACT

A water/surfactant process for removing oil from a soil that has been contaminated by an oil spill. The surfactant is carefully selected from a group consisting of linear alcohols having eight to fifteen carbon atoms and two to eight ethylene oxide units on the carbon atoms. The surfactant concentration is also held to about 0.5 percent, by volume, or less to minimize the formation of an emulsion between the oil and the wash water. The process provides a clean separation of the oil from the soil as well as from the water. The limited surfactant also minimizes dispersion of clay fines from the soil into the water. The water/surfactant is heated for improved removal of oil from the soil.

12 Claims, 1 Drawing Sheet

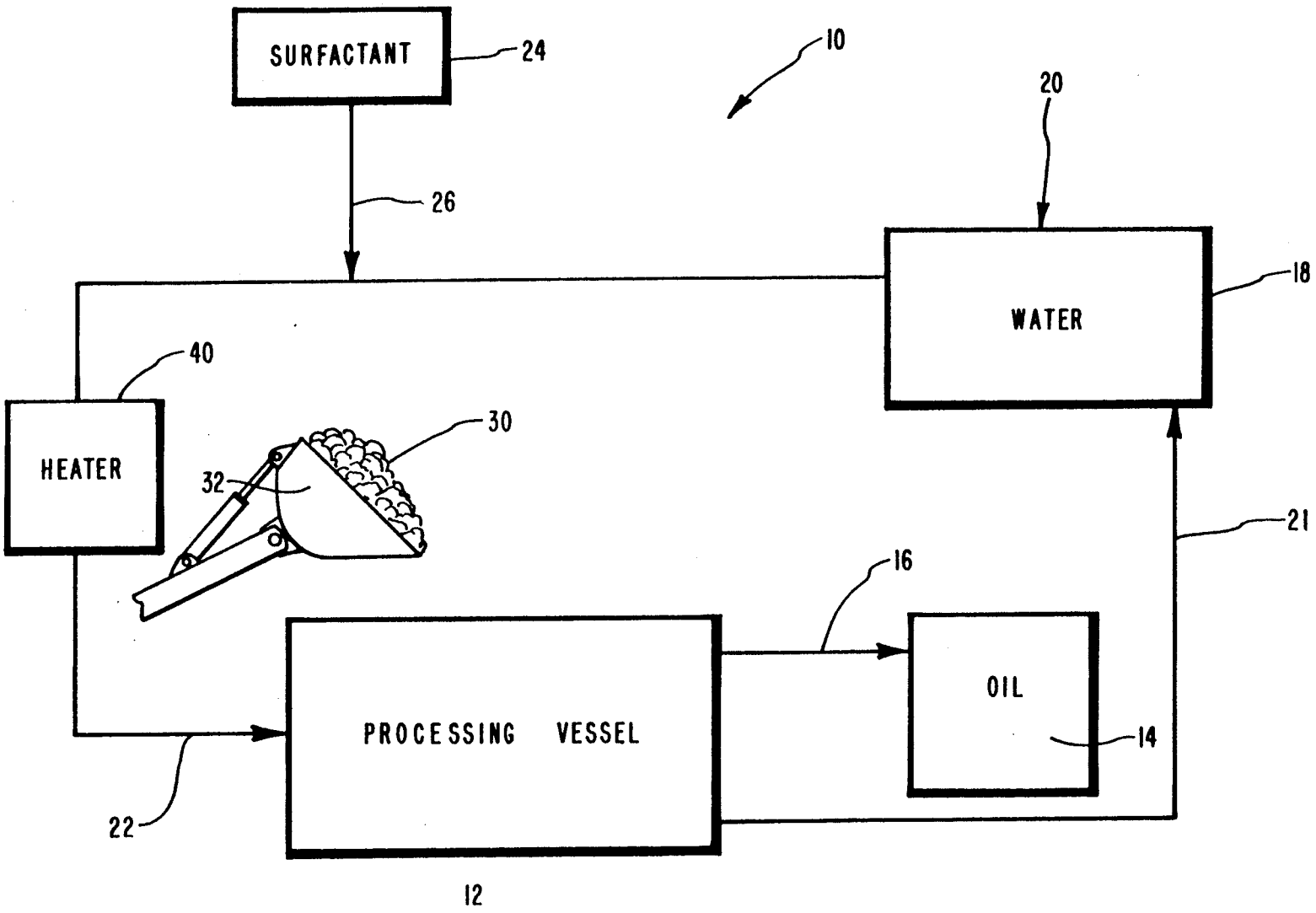
10
WATER
18
20
21
OIL
14
16
PROCESSING VESSEL
12
SURFACTANT
24
26
30
32
HEATER
40
22

WATER/SURFACTANT PROCESS FOR RECOVERING HYDROCARBONS FORM SOIL IN THE ABSENCE OF EMULSIFYING THE OIL

RELATED APPLICATIONS

This application is a continuation-in-part application of my copending application Ser. No. 07/607,995 filed Nov. 1, 1990 for WATER/SURFACTANT PROCESS FOR RECOVERING HYDROCARBONS FROM SOIL now abandoned which is a continuation-in-part application of my copending application Ser. No. 07/490,089 filed Mar. 7, 1990 for SOLVENT AND WATER/SURFACTANT PROCESS FOR REMOVAL OF BITUMEN FROM TAR SANDS CONTAMINATED WITH CLAY, now U.S. Pat. No. 4,968,412, issued Nov. 6, 1990, which is a continuation-in-part application of my copending application Ser. No. 07/297,670 filed Jan. 17, 1989 for PROCESS FOR REMOVAL OF BITUMEN FROM TAR SANDS CONTAMINATED WITH CLAY (now abandoned).

BACKGROUND

1. Field of the Invention

This invention relates to a novel process for recovering hydrocarbons from soil and, more particularly, to a water/surfactant process wherein a carefully selected surface active agent is added to the water to provide a clean separation of the hydrocarbons from the soil while limiting emulsification of the hydrocarbons while minimizing contamination of the water with either hydrocarbon residue or clay from the soil.

2. The Prior Art

The term "oil spill" is commonly used to define an accidental discharge of a liquid hydrocarbon in either a water environment or directly on the soil. To be technically correct, the term should be "hydrocarbon spill" since the material spilled ranges from crude oils to refined products such as heating oils, diesel fuel, gasoline, lubricating oil, and the like. Oil spills can range from a small seepage of a few liters of hydrocarbon liquid to millions of liters, for example, when a supertanker suffers a ruptured hull. However, for purposes of convenience and to conform to the popular vernacular, the term "oil spill" will be used throughout. Various techniques have been implemented for handling an oil spill on water. These include the use of skimmers, containment booms, absorbents, dispersants, and microbial digestion systems. Ultimately, however, a significant portion of the spilled oil reaches shore where it contaminates the soil and thus represents a significant environmental problem. The recovery of oil from oil-contaminated soil is difficult because soil includes a broad spectrum of materials ranging from fine clays to sand, gravel, and rocks along with a certain amount of humus in the form of decaying vegetable matter. As such, an oil spill on soil represents a particularly difficult challenge.

Customarily, it is the practice to treat oil spills on beaches, for example, by absorbing excess oil with an absorbent material and then treating the residual oil on the beach soil with detergents and microbes to break down the remaining oil. An alternative practice is to process the contaminated soil through a high-temperature furnace to burn off the oil. Neither of these procedures is satisfactory since the first process creates unwanted byproducts and the second process is expensive and produces a sterile, undesirable soil residue Importantly, the removal of oil using a surfactant historically has resulted in an emulsion of water and oil with a fine clay suspended therein This emulsion is extremely difficult to process.

One form of a naturally occurring "oil spill" is found in tar sand deposits where the hydrocarbon is present in the form of bitumen dispersed throughout a body of sand, albeit in relatively low concentrations. Certain types of bitumen have an extremely high viscosity and are bonded directly to the grains of sand while others include a thin film of connate water interposed between the bitumen and the sand grains. Numerous processing schemes have been proposed for recovering this bitumen from the tar sand deposits and include thermal processes, solvent processes, water processes, and hybrid combinations of these processes. However, the processing of tar sands, while presenting a fairly complex set of processing problems, is relatively simple when compared to the recovery of oil from a soil contaminated by an oil spill. First, the oil in an oil spill can be from any source; and, second, soil is a highly complex composition that has a wide range of constituents unlike the sand in a tar sand deposit. This means that most, if not all, prior art strategies for processing tar sands to recover bitumen are unusable with regard to recovering oil from an oil spill and returning the cleaned soil to its original location In most cases, conventional, tar sand processing schemes will simply create more problems than are solved when used to recover oil from an oil spill. In particular, the retention of residual oil by the soil must be reduced to an acceptable level while, simultaneously, great care must be taken to assure minimal dispersion of clay from the soil into the cleansing solution, whether an organic solvent or water.

The reference of Martin (U.S. Pat. No. 4,380,268) teaches the removal of paraffin deposits from oil wells. The preferred detergent degreaser comprises a ten or eleven carbon linear alcohol reacted with 6 mols of ethylene oxide and then reacted with a ten carbon linear alcohol For maximum performance, sodium silicate anhydrous is added. The detergent degreaser is diluted with water which has been heated to 130° F.

Clearly, of course, such a detergent degreaser is intended to emulsify and remove the paraffin from the oil well. If the paraffin were not emulsified, the paraffin would separate from the water during the 24 to 48 hour shut down of the well and render the pumping effort during repumping phase difficult if not impossible due to the known plugging effect of paraffin in the well.

It is also important to note that the Martin reference does not teach the removal of oil from soil since it is directed only to removal of paraffin from an oil well. Martin is using this detergent degreaser as a new solvent and, therefore, the concentrations must be high in that the hydrocarbon chain in the surfactant is dissolving the paraffin while the ethylene oxide portion binds the paraffin to the water. This is the regular mechanism by which a surfactant works. The silicate increases the pH of the water which is also essential to enable the surfactant to work in its customary way.

In view of the foregoing, what is needed is a processing strategy for recovering hydrocarbons from soils contaminated as a result of an oil spill while at the same time limiting the formation of an emulsion between the hydrocarbons and the water. It would also be an advancement in the art to provide a processing strategy whereby a soil contaminated with oil can be easily and relatively economically cleaned and, if desired, returned to its original site after the oil has been recovered. An even further advancement in the art would be to provide a water/surfactant process for producing a relatively clean soil while significantly minimizing emulsifying the oil into the water resulting in a significant reduction in the contamination of the water. Such a novel process is disclosed and claimed herein.

BRIEF SUMMARY AND OBJECTS OF THE INVENTION

This invention relates to a novel, water/surfactant process whereby hydrocarbons are recovered from a hydrocarbon-contaminated soil using water to which a carefully selected surfactant has been added as the recovery vehicle. The surfactant is carefully selected so that it dislodges the hydrocarbon from the soil without emulsifying the hydrocarbon. Further, the surfactant is carefully selected to keep the water relatively clear by keeping most of the clay and other fines in the soil.

It is, therefore, a primary object of this invention to provide improvements in processes for recovering hydrocarbons from soils upon which hydrocarbons have been spilled Another object of this invention is to provide a novel process for cleanup of hydrocarbon-contaminated soils by using a water/surface active agent system to release the residual hydrocarbons from the soil, the surface active agent being carefully selected to preclude emulsification of the hydrocarbons while limiting dispersion of the clays and other fines in the soil into the water phase.

Another object of this invention is to provide a relatively low temperature water process for recovering hydrocarbons from a soil contaminated by the hydrocarbons.

These and other objects and features of this invention will become more readily apparent from the following description in which preferred and other embodiments of the invention have been set forth along with a drawing and appended claims.

BRIEF DESCRIPTION OF THE DRAWING

The drawing is a schematic flow diagram illustrating a presently preferred embodiment of the novel process of this invention for removing hydrocarbon contaminants from soil.

DETAILED DESCRIPTION OF THE INVENTION

The invention is best understood by reference to the following detailed description in conjunction with the drawing wherein like parts are designated with like numerals throughout.

General Discussion

Oil spills, regardless of the source, represent an ecological problem not only from the standpoint of simple aesthetics but also from the standpoint of long-term damage to the environment. Until the present invention there has been no satisfactory method for recovering spilled hydrocarbons from the soil, the basic problems being that the necessary surfactants emulsify the hydrocarbons with the wash water and soil is an incredibly complex mixture including extremely fine clay, various silts, humus, sand, and gravel, to name a few. It is, therefore, extremely difficult to recover spilled hydrocarbon from soil without creating an even greater ecological problem both in the water as well as the soil residue. For example, any prior art, water-based recovery strategy will most likely result in the water phase becoming contaminated with not only a suspension of clay and other fine silt from the soil but also from residual hydrocarbon that has been emulsified by the particular surfactant employed in the process. This problem is graphically demonstrated by the huge expanses of settling ponds required to hold the clay and residual bitumen-contaminated water generated by the Athabasca tar sand recovery processes in Alberta, Canada. The clay suspended in the process water is the primary reason for the presence of these vast holding ponds since it is environmentally unacceptable to discharge these clay-contaminated waters into streams or lakes. Further, sufficient hydrocarbon residues are emulsified and carried over into the water phase to create a water pollution problem in itself.

Thermal processes also encounter problems when clay is present in the oil-contaminated soil to any appreciable amount. In particular, the extremely fine particle size of the clay means that these particles will be carried over into the gaseous phase, for example, from any type of thermal, fluidized bed process. Additionally, there is an inherent risk that the clay may sinter on hot surfaces during any coking process.

Advantageously, the process of the present invention uses a surface active agent that is carefully selected so as to disengage the hydrocarbons from the soil without emulsifying the hydrocarbons and without unduly dispersing soil fines such as clay into the water phase. The surface active agent acts as a super wetting agent allowing the water/surface active agent mixture to replace the hydrocarbons on the polar surface if a shear force is used to help loosen the hydrocarbon from the surface of the soil particles. This water wash cycle may be repeated several times to assure essentially complete removal of the hydrocarbons from the soil.

Surface active agents or surfactants can be categorized in three general categories: Cationic, Anionic, and Nonionic. I have discovered that a very narrow range of nonionic surfactants provides the necessary characteristics that make this process feasible. Table I sets forth a run of experiments on tar sand residues that had been previously processed with solvent to remove ninety percent of the bitumen. The purpose of the experiment was to demonstrate how this material was wetted by water alone verses water to which had been added various types of surface active agents.

Table II outlines my discovery that a surfactant selected from primary or linear alcohols with a narrow range of carbon atoms in the primary alcohol chain provides optimal separation and to which are attached a limited number of ethylene oxide units from the ethoxylate family. The number of ethoxy groups on the carbon atoms in the chain are selected within a relatively narrow range since the greater the number of ethoxy groups on the surfactant molecule, the more soluble the hydrocarbon will be in water. This must be balanced with the fact that the higher number of ethoxy groups causes an increased rate of disengagement of the hydrocarbon from the soil.

Correspondingly, the lower range of carbon atoms in the surfactant provides a faster release of hydrocarbon from the soil. For example, a surfactant with eight carbon atoms results in a very fast release of hydrocarbon from the soil, much faster than a surfactant with 12 or 15 carbon atoms. However, an undesirable feature is that surfactants of this type also form emulsions between the released hydrocarbon and the water, an event that must be avoided in order to make this process economically feasible.

TABLE I

Comparison of Wetting Action on Residual Bitumen-Contaminated Sand From Solvent Recovery Process of Tar Sand

| Aqueous Medium | Results |
|---|---|
| 1. Water (only) | Not wetted |
| 2. Water with base | Wetted slowly |
| 3. Water with 0.5% Cationic surfactant | Not wetted |
| 4. Water with anionic surfactant | Wetted slowly (wetting due to solution being basic) |
| 5. Water nonionic surfactant (alcohol ethoxylate) | Wetted immediately |

TABLE II

Behavior of Nonionic Primary Alcohol Ethoxylates (E.O. Units) with Varying Surfactant Concentrations

| | | |
|---|---|---|
| 2 E.O. Units regardless of concentration | The water layer clear, no color | Lots of clay floaters at both interfaces |
| 3 E.O. units regardless of concentration | Same as above | Same as above |
| 6 E.O. units | | |
| .5% | Water layer light brown | Settles out, few clay floaters[1] |
| .3% | Water layer colorless | Settles out, few clay floaters[1] |
| 7 E.O. units | | |
| .5% | Water layer light brown | Very few clay floaters[1] |
| .3% | Water layer colorless | Very few clay floaters[1] |
| 8 E.O. units | | |
| .5% | Water layer light black | At end of 10 minutes no clay floaters[2] |
| .3% | Water layer dark brown | At end of 10 minutes no clay floaters[2] |
| 11 E.O. units | Water layer is black-black, with no observed change within one hour | Too dark to tell |

[1]Settled out leaving a clear solution within 5 minutes settling time.
[2]The black layer in the water contains oil and clay. A layer of fine, tan clay settles out as the solution clears up. This clearing takes place within 10 minutes.

Another important limitation is the amount of the surfactant in the water phase. For example, a surfactant of this invention having eight carbon atoms and three ethoxy groups in a concentration range of three to four percent will produce a complete emulsion. I have found that the maximum allowable concentration of surfactant suitable for the practice of this invention must not exceed about one-half percent, by volume. This surfactant ratio must be carefully monitored during the recycle of the water so that the injection of makeup surfactant into the recycle stream does not result in the presence of excess surfactant. This is important since a certain fraction of surfactant will be lost with the recovered hydrocarbon phase and some will be carried away by the soil so that a carefully controlled amount of makeup surfactant must be added as required.

The conclusion to be derived from an analysis of the results displayed in Table II is that the two to three ethoxylate units provide a superior surface active agent as long as the clay floaters do not present interface separation problems during continuous processing. The advantage of this surfactant range is that there is virtually no water contamination problem.

Ethoxylate units in the six to eight range present clean interfaces but require at least ten minutes settling time before the water can be reused. This time requirement may or may not adversely affect the continuous processing strategy. Greater than eleven ethoxylate units renders the surfactant unusable.

Another study was conducted to determine the rate at which the bitumen/solvent residue separates from the sand phase during the water-wash cycle. Comparisons were made using alcohols with eight, twelve and fifteen carbon atoms, C-8, C-12, and C-15, respectively, and with ethoxylate units ranging between three and eight. The studies found that the C-12 and C-15 alcohols were identical with both three and seven ethoxylate units, the seven ethoxylate units being faster. Surprisingly, the C-8 alcohol produced the fastest and cleanest separation with the greater number of ethoxylate units. The results of this study are summarized in Table III.

TABLE III

Comparison of Carbon Atoms in Alcohol Chain Length with Number of Ethoxylate Units

| Alcohol Chain | Ethoxylate Units | Results | % of Bitumen left on sand after 1 minute surfactant wash |
|---|---|---|---|
| C-8 | 6 | Very large oil drops (¼ in.) Separation complete in 30 seconds | 14% |
| C-8 | 8 | Very large oil drops (¼ in.) Separation complete in 30 seconds | 18% |
| C-15 | 7 | Oil drops (⅛ in.) work way out for 4–5 minutes | 33% |
| C-15 | 3 | Oil drops (⅛ in.) without agitation still coming out after 10 minutes | 36% |

In conclusion, the C-8 alcohol with six to eight ethoxylate units appears to be the ideal surface active agent for this process. This surfactant gave the best rate of recovery, a clean separation of phases with no clinging clay/bitumen in the water/bitumen interface. Additionally, this surfactant gave the highest percentage of bitumen recovery with the least number of process steps. However, great care must be taken to assure that even this surface active agent is maintained at less than 0.5 percent, by volume, since even at three percent, by volume, this surfactant produces a complete emulsion.

EXAMPLE I

An oil spill was simulated by mixing a known quantity of oil with a predetermined amount of ordinary soil. In the first instance a relatively dirty, dry sand (about 90% sand with about 10% dirt fines of silt and clay, by weight) was obtained and saturated with Nevada crude oil. Nevada crude oil is known in the art as a heavy crude and was present in the soil in an amount of 45%, by weight. This artificially created oil spill was processed using a water/surfactant wash with two different surfactants. The first surfactant was an eight carbon alcohol with eight attached ethylene oxide units, the surfactant found to be the most active surfactant for the removal of bitumen from tar sand.

The second surfactant was a fifteen carbon alcohol with three ethylene oxide groups, one of the least active members of this family of surfactants. A measured quantity of oil/sand mixture was processed with 200%, by volume, water/surfactant solution in a single pass using cool tap water at 20° C. and hand agitation in a closed container. The results are tabulated in Table IV.

TABLE IV

Comparison of C-8 Alcohol with 8 Ethylene Oxide Units and C-15 Alcohol with 3 Ethylene Oxide units

| Run | Surfactant Concentration | Oil Remaining (by weight | Results: Water | Results: Sand |
|---|---|---|---|---|
| C-8 alcohol with 8 ethylene oxide units: | | | | |
| 1 | 0.5% | 2.43% | Clean sharp interface with water/oil layer in 10 min. | Visibly clean sand |
| 2 | 0.25% | 4.14% | Clean sharp interface with water/oil layer in 10 min. | Visibly clean sand |
| 3 | 0.125% | 6.05% | Visibly dirty interface with water/oil formed in 5 min. | Visibly dirty sand |
| C-15 alcohol with 3 ethylene oxide units: | | | | |
| 4 | 0.5 | 7.87% | Dirty interface with oil/water formed in 5 min. | Visibly dirty sand |

The liquid solutions were darker with the crude oil than with the solvent/bitumen from tar sands, but the water/surfactant solution cleared within five to ten minutes. As with tar sands, the eight carbon alcohol surfactant is a superior surfactant and is very useful with concentrations of about 0.5%, by weight. Concentrations above one percent are very slow in achieving a clear water layer with a distinct boundary between the oil and water.

EXAMPLE II

Another experiment was conducted using Nevada crude oil on ordinary garden soil or loam in the amount of 60%, by weight, crude oil to moist loam, the loam being saturated with the crude oil. The loam contained sand, silt, and clay, and, when mixed with water alone, resulted in a turbid water (created the clay present in the soil) that required hours to settle.

Again, the best surfactant was an eight carbon alcohol having eight ethylene oxide units at 0.5%, by weight, concentration. In this second series of experiments, the temperature of the water was changed, the results thereof being set forth in Table V.

TABLE V

Garden Loam Saturated with 60%, by Weight, Nevada Crude and Processed in a Single Wash Using 200%, by Volume, Water Having 0.5%, by Weight, C-8 Alcohol with 8 Ethylene Oxide Units

| Run | Water Temperature | Oil Remaining (% by Weight) | Results |
|---|---|---|---|
| 1 | 20° C. | 2.8% | Visibly clean soil with settle rate the same as the dirt with oil. Solution became clear in 10 minutes. |
| 2 | 30° C. | 1.0% | Visibly clean soil with settle rate the same as the dirt with oil. Solution became clear in 5 minutes. |
| 3 | 60° C. | 0.1% | Visibly clean soil with settle rate the same as the dirt with oil. Solution became clear in 5 minutes. |

Table V clearly shows that visibly clean soil can be achieved at all temperatures, but that an increase in the water temperature produces a surprising decrease in the amount of residual oil.

EXAMPLE III

In this series of experiments, a light Wyoming crude (API of 44, mostly gasoline and diesel) was mixed with a clean sand to create an artificial oil spill. When processed using the most active surfactant (eight carbon alcohol with eight ethylene oxide groups) at 0.5% concentration, the oil and water formed a stable emulsion which means this surfactant was unusable for this type of oil spill.

EXAMPLE IV

In view of the negative results from Example III, above, I then used one of the least active surfactants (fifteen carbon alcohol with three ethylene oxide groups) on a sand saturated with 30%, by weight, light Wyoming crude. Importantly, a 0.5% concentration of this surfactant did not form an emulsion. The three layers were always distinct with a sharp interface between the oil and the water. Only one cold surfactant wash followed by one warm water rinse was required to recover 97% of the oil.

EXAMPLE V

I then mixed 30%, by weight, light Wyoming crude with loam soil (see, Example II) and washed this artificially created oil spill with the wash water of Example IV, above. For comparison purposes, I also used plain loam soil (no oil) which I washed with this wash water. The major portion of the clay fines settled out in about ten minutes in both samples although the water phase was still somewhat murky with suspended clay. However, the interface between the oil and the water was distinct and 97% of the oil was removed with one washing step with surfactant followed by one rinse using plain water.

EXAMPLE VI

Contaminated sandy soil using a diesel oil containing 4.8% hydrocarbon 200 grams of contaminated soil was vigorously mixed with 400 ml of water containing the following types and percent surfactant:

| $C_8$—[O—C—C—O]$_8$—OH | % | Results |
|---|---|---|
| $C_8$—[O—C—C]$_8$—O—H | 1.0% | After mixing, the total solution was black with no visible phase boundaries during the first 6 hours. The oil layer and water |

-continued

| $C_8$—[O—C—C—O]$_8$—OH | % | Results |
|---|---|---|
| | | had separated 24 hours later. |
| $C_8$—[O—C—C]$_8$—OH | 0.50% | Immediately after mixing, the solution was dark. Clear water was present above sand in 30 seconds, and a clear division between water and oil was present in 45 minutes. |
| $C_8$—[O—C—C]$_8$—OH | 0.35% | Clear layer was present above sand immediately after mixing. Water layer was totally clear within 10 minutes. |
| $C_8$—[O—C—C]$_8$—OH | 0.1% | Water layer was clear immediately after mixing, with distinct separable water-oil layers within 30 seconds of mixing. The volume of recoverable oil was less than with .50% and .35%. |

EXAMPLE VII

Cleaning Oil Production Sands

This sand was obtained from the production of oil in the Gulf of Mexico. This oil sand contained 12.04% oil and 2.2% water. The reaction of 200 grams of oil sand was vigorously mixed with 400 ml of water containing $C_8$—[O—C—C]$_8$—OH surfactant in the following percentages. The oil in this sand was a yellow crude.

| Percent Surfactant | |
|---|---|
| 2.0% | Formed a yellow homogeneous solution which had no visible distinction between layers after 4 days. |
| 0.50% | Formed a yellow solution with no visible layer present in the first 10 minutes. The solution started to clear up in 30 minutes with clear oil-water phases after 2 hours. |
| 0.25% | Lower part of water layer was clear immediately after mixing and solution was totally clear with a separable oil layer in 45 minutes. |
| 0.125% | Oil layer was immediately present after mixing and water solution had cleared up in 15 minutes. |

Another test was made on this oil sand using 400 ml water containing 0.50% $C_{15}$—[O—C—C]$_3$—OH surfactant. Upon agitation the mixture formed a yellow solution that immediately started to separate into layers. Visible oil was present immediately after mixing. Solution completely cleared up in 30 minutes.

EXAMPLE VIII

Example VII was run to determine the conditions needed to clean the sand in an 8-ton per hour washing unit, which consisted of the following series: a mixer, a jet shear, a quiet separation tank for the oil to collect, a hydrocyclone and then a horizontal centrifuge to remove liquid from the clean sand. The data in Example VII indicated that $C_{15}$—[O—C—C]$_3$—OH was the preferred surfactant. It was not available, so 0.10% , $C_8$—[O—C—C]$_8$—OH the second choice which was available was used in the continuous test.

In a single pass through the unit, the 12.04% oil-sand was reduced to visible clean sand with no oil smell. The cleaned sand contained 0.0852% oil, with 99.4% of the oil removed from the sand in a recoverable form that could be sold as crude oil. The same water-surfactant solution was continuously reused during the six hours the unit was run. An earlier test, run with a mixer only, on this same oil-sand, and 0.2% $C_8$—[O—C—C]$_8$—OH surfactant with 4 passes through this mixer reduced the oil below 400 parts per million.

The Preferred Embodiment

Referring now to the drawing, a first, presently preferred embodiment of the process apparatus for the practice of this invention is shown generally at 10 as a flow schematic and includes a vessel 12, an oil collection reservoir 14, a water storage 18, and surfactant source 24. Vessel 12 is an suitable containment chamber and may include such devices as a hydrocyclone, a bottom-discharge container, a dump vessel, and the like. The primary function of vessel 12 is to receive a body of soil 30 which has a quantity of oil therein as a contaminant and to expose this oil in soil 30 to a wash water 22 which water includes a surfactant 26. Clearly, the flow schematic of process apparatus 10 is greatly simplified since numerous standard features such as agitators, pumps, valves, and the like have been omitted for the sake of clarity and simplicity in presenting the novel features of this invention.

If vessel 12 were selected as a conventional hydrocyclone, for example, incoming soil 30 would be vigorously washed with wash water 22 in its passage therethrough. On the other hand, if vessel 12 were a simple dump vessel having an agitator therein and being operable to be pivotally rotated to an inverted position, soil 30 would remain in vessel 12 until it was inverted. Clearly of course the precise features of vessel 12 are relatively unimportant as long as soil 30 is suitably contacted with wash water 22.

Soil 30 is soil recovered from any applicable source of soil that has been contaminated with oil 16 including, for example, a conventional oil spill such as may result from the accidental rupture of a pipeline or other oil transportation system, beach sand from the shoreline adjacent a water-borne oil spill, and the like. Soil 30 is delivered to vessel 12 by any suitable mechanism such as a conveyor belt, dump truck or a mechanical loader 32, a fragment of which is shown schematically herein.

At this point it should be clearly set forth that process apparatus 10 can be fabricated with any suitable size configuration so as to accommodate quantities of soil 30 in amounts ranging from a few tons to hundreds of tons per cycle. Further, process apparatus 10 can be designed to be mounted on a movable platform such as a truck chassis to accommodate its being transported to the site of an oil spill. Accordingly, mechanical loader 32 will be selected from any suitable delivery mechanism for soil 30. The feature of portability can be an important feature particularly since the entire process of recovering oil 16 from soil 30 becomes a materials handling problem of significant proportions once the novel water/surfactant process of this invention has solved the problem of separating oil 16 from soil 30. Alternatively, of course, process apparatus 10 can be configured as either a permanent or a semipermanent installation for processing of soil 30 obtained from any suitable source.

Water 20 is introduced into water reservoir 18 where it is combined with recycle water 21 from vessel 12 and amended with surfactant 26 from surfactant supply 24 to become wash water 22. The amount of surfactant 26 in wash water 22 is very carefully controlled so as to provide the optimum separation of oil 16 from soil 30 while at the same time minimizing the emulsification of oil 16 in recycle water 21 and the dispersion of clay fines from soil 30 into recycle water 21. I have found that surfactant 26 must be selected from a relatively narrow range of surfactants; otherwise, excessive emulsification of oil 16 occurs. Increased suspension of clay fines from soil 30 is also encountered if the wrong type or excessive amounts of surfactant 26 are used to formulate wash water 22.

Heater 40 is optional, but the results shown in Table V clearly demonstrate the surprising advantage to be obtained through heating wash water 22. Heater 40 may be any suitable heater and may even be configured to burn a portion of recovered oil 16 as the source of thermal energy for heater 40.

Soil 30 is processed in vessel 12 by being intimately contacted with wash water 22. This is accomplished either through agitation by a conventional mechanical agitator (not shown) or by introducing wash water 22 as a jet which provides the necessary degree of agitation. In either circumstance, surfactant 26 in wash water 22 dislodges oil 16 from soil 30 allowing oil 16 to thereafter be floated to the surface of wash water 22 in vessel 12 where it is skimmed and directed into oil reservoir 14.

Recycle water 21 is drawn off from vessel 12 and held in water reservoir 18 where it is supplemented with water 20 until needed as wash water 22. Suitable controls are used in the operation of vessel 12 to assure that the desired recovery of oil 16 is achieved along with maintenance of the quality of recycle water 21. For example, it may be necessary to allow soil 30 to reside in vessel 12 for a predetermined period of time in order for oil 16 to migrate to the surface of wash water 22. Further, a period of quiescence will also allow clay fines in soil 30 to settle toward the bottom of vessel 12 thereby significantly reducing residual turbidity of recycle water 21.

Soil 30 from which oil 16 has been removed is now in condition to be removed from vessel 12 and either returned to its original location or deposited as fill at some other suitable location. Importantly, the novel process of this invention lowers the amount of residual oil therein to almost negligible amounts. However, in those circumstances where conditions dictate, soil 30 can be subjected to additional wash cycles if it is determined that even the small amounts of residual oil 16 remaining therein after being processed by a single pass through process apparatus 10 are unacceptable. In such cases, the ongoing processing strategy is essentially identical particularly with respect to the amount of surfactant 26 present in wash water 22.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A process for removing oil from soil contaminated with said oil in the absence of emulsifying said oil or suspending said soil in the wash water comprising:

obtaining soil contaminated with oil;

placing said soil contaminated with said oil in a vessel;

selecting a surfactant from the group consisting of a linear alcohol having carbon atoms within the range on the order of about eight to fifteen carbon atoms and ethylene oxide units on the carbon atoms within the range on the order of about two to eight ethylene oxide units;

preparing a wash water by mixing said surfactant with water;

introducing said wash water into said vessel;

washing said soil contaminated with said oil with said wash water, said wash water dislodging said oil from said soil, said water floating said oil away from said soil;

preventing an emulsion being formed between said oil and said wash water by limiting said surfactant to an amount less than 0.5 percent, by volume; and removing said oil from said vessel.

2. The process defined in claim 1 wherein said obtaining step comprises selecting said soil contaminated with oil from an oil spill.

3. The process defined in claim 1 wherein said selecting step comprises choosing said surfactant from the group consisting of a linear alcohol having carbon atoms within the range on the order of about eight to fifteen carbon atoms and ethylene oxide units on the carbon atoms within the range on the order of about two to eight ethylene oxide units.

4. The process defined in claim 1 wherein said preventing step comprises maintaining said surfactant in said water in an amount less then about 0.5 percent, by volume.

5. The process defined in claim 1 wherein said washing step includes agitating said soil contaminated with said oil and said wash water.

6. The process defined in claim 1 wherein said preparing step includes recycling said water from said introducing step and adding any additional surfactant as may be required while limiting said surfactant to an amount no greater than about 0.5 percent, by volume, thereby precluding emulsifying said oil and said wash water.

7. The process defined in claim 1 wherein said removing step includes withdrawing said water and removing said soil from said vessel.

8. The process defined in claim 1 wherein said preparing step includes heating said wash water.

9. A process for removing oil from a soil contaminated by said oil comprising:

obtaining a chamber;

selecting a surfactant from the group consisting of a linear alcohol having carbon atoms within the range on the order of about eight to fifteen carbon atoms and ethylene oxide units on the carbon atoms within the rage on the order of about two to eight ethylene oxide units;

forming a wash water by mixing said surfactant with water;

washing said soil contaminated with oil by passing soil contaminated with oil through said chamber and introducing said wash water into said chamber thereby dislodging said oil with said surfactant in said wash water and floating said oil with said wash water; and inhibiting the formation of an emulsion between said oil and said wash water by limiting said surfactant to an amount up to about 0.5 percent, by volume.

10. The process defined in claim 9 wherein said forming step includes heating said wash water.

11. A process for cleaning soil contaminated by an oil spill comprising:

preparing a wash water for washing said soil contaminated by an oil spill by mixing a surfactant with water, said surfactant being selected from the group consisting of a linear alcohol having carbon atoms within the range on the order of about eight to fifteen carbon atoms and ethylene oxide units on the carbon atoms within the range on the order of about two to eight ethylene oxide units;

heating said wash water;

washing said soil contaminated by said oil spill with said wash water;

floating said oil away from said soil;

preventing the formation of an emulsion with said oil by limiting said surfactant concentration to an amount within the range on the order of about 0.5 percent, by volume.

12. The process defined in claim 11 wherein said washing step includes passing said soil contaminated by said oil spill into a vessel and washing said soil contaminated by said oil spill with said wash water in said vessel.

* * * * *